US006302156B1

(12) United States Patent
Lardet et al.

(10) Patent No.: US 6,302,156 B1
(45) Date of Patent: Oct. 16, 2001

(54) MACHINE FOR CONTINUOUS WIRE STRINGING ON SUCCESSIVE POLES

(75) Inventors: Pierre Lardet, Sevelinges; Hubert Gentay, Saint Germain D'Aunay, both of (FR)

(73) Assignee: Hubert Gentay (FR)

( * ) Notice: Subject to any disclaimer, the term of this patent is extended or adjusted under 35 U.S.C. 154(b) by 0 days.

(21) Appl. No.: 09/402,777

(22) PCT Filed: Apr. 10, 1998

(86) PCT No.: PCT/FR98/00739

§ 371 Date: Jan. 3, 2000

§ 102(e) Date: Jan. 3, 2000

(87) PCT Pub. No.: WO98/46844

PCT Pub. Date: Oct. 22, 1998

(30) Foreign Application Priority Data

Apr. 11, 1997 (FR) ..... 97 04716
Jul. 11, 1997 (FR) ..... 97 09109

(51) Int. Cl.[7] ..... B21F 33/00
(52) U.S. Cl. ..... 140/16; 242/557
(58) Field of Search ..... 140/16, 107, 108; 242/557, 566

(56) References Cited

U.S. PATENT DOCUMENTS

| | | | | |
|---|---|---|---|---|
| 337,119 | * | 3/1886 | Bigelow | 140/16 |
| 906,547 | * | 12/1908 | Moss | 140/16 |
| 3,002,726 | | 10/1961 | Ford . | |
| 3,356,341 | | 12/1967 | Brown . | |

FOREIGN PATENT DOCUMENTS

| | | |
|---|---|---|
| 3 507 543 | 9/1986 | (DE) . |
| 2 624 542 | 6/1989 | (FR) . |
| 2 719 837 | 11/1995 | (FR) . |

* cited by examiner

*Primary Examiner*—Lowell A. Larson
(74) *Attorney, Agent, or Firm*—Cantor Colburn LLP

(57) ABSTRACT

The invention concerns a machine comprising: at least a brake coil, containing a wire to be strung; at least a roller for receiving, coiled about it, the wire unwound by the coil and for appropriately directing the wire for strining; and means for displacing the roller between a retracted position, where the roller is located on the near side the plane defined by two consecutive supports, and a projecting position, wherein the roller is located beyond the plane.

8 Claims, 3 Drawing Sheets

FIG 1
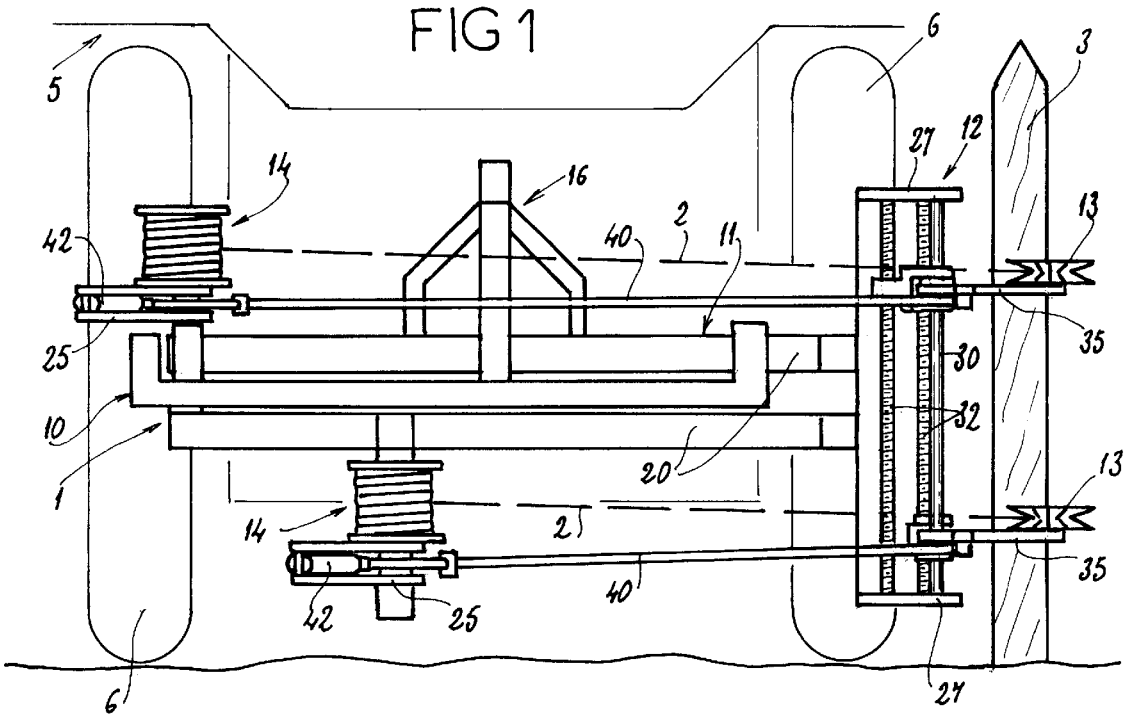
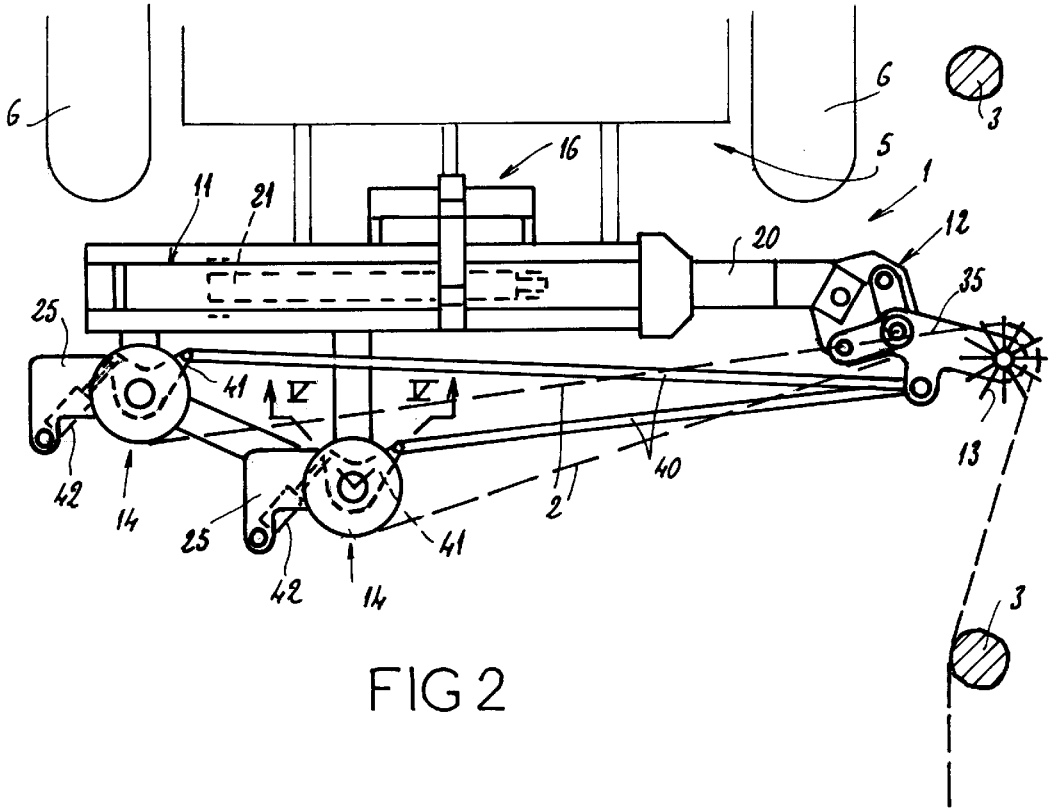
FIG 2

MACHINE FOR CONTINUOUS WIRE STRINGING ON SUCCESSIVE POLES

TECHNICAL FIELD

The present invention relates to a machine for continuously affixing wires, or similar elongate material, onto successive supports, especially posts planted in the ground. This machine is intended mainly for the continuous construction of fences.

BACKGROUND OF THE INVENTION

At present, when constructing a fence, the wires are affixed manually, which requires the work of several persons, and is particularly lengthy and tedious.

A machine exists allowing the fence wires to be affixed continuously, which, however, does not give entire satisfaction in practice. This is because it exhibits certain drawbacks, as regards the positioning of the wires with respect to the posts for the purposes of nailing them on. It is difficult to adapt to uneven ground and is of restricted productivity.

Document DE-A-35 07 543 discloses a machine comprising at least one braked reel, containing the wire to be affixed;

at least one roller capable of receiving, engaged around itself, the wire paid out by the reel and of orienting this wire appropriately with a view to affixing it.

SUMMARY OF THE INVENTION

The invention aims to remedy these drawbacks in a simple, effective and rational way.

The machine to which it relates is of the type disclosed by the abovementioned document and comprises, according to the invention, means making it possible to shift the said roller between a retracted position, in which this roller is situated short of the plane defined by consecutive supports, and an extended position, in which this roller is situated beyond this plane.

In the said retracted position, the roller allows the machine to pass along the supports intended to receive the wire. As soon as it has passed, the roller is shifted into extended position, so that it takes the wire beyond the plane defined by the supports and makes it possible to press this wire against the closest support. It then makes it possible to hold the wire in this position for the time it takes an operator to fix this wire onto this support.

The braking of the reel and the shifting of the roller into extended position make it possible to ensure a perfect tensioning of the wire for the time it takes to affix this wire onto the support.

The machine preferably comprises several reels, especially two or four, for simultaneous affixing of several wires, and comprises a number of rollers corresponding to the number of reels.

Advantageously, means are provided to allow height adjustment of each roller with respect to the supports intended to receive the wire. The same machine thus makes it possible to affix wires at different heights. For example, a fence with four wires can be constructed by a machine with two reels, the second and fourth wires being affixed in the course of a first pass, then the first and third wires in the course of a second pass. Means can be provided to allow height adjustment of each reel, so that the latter can be placed substantially at the same height as the roller which corresponds to it. In a variant, each reel can be situated at a relatively large distance from the roller which corresponds to it, such that the angle formed by the wire and the axis of the roller varies little according to the various height positions of this roller.

Advantageously, the machine comprises a supplementary roller, not corresponding to a reel. This roller is intended to roll along a previously affixed wire, and thus constitutes a guide making it possible to monitor the separation between the wire or wires being affixed and the wire or wires previously affixed.

The machine preferably comprises a chassis;

a beam, mounted on this chassis in such a way that one of its ends is turned, while the wire is being affixed, towards the supports which are to receive the wire, this end including the abovementioned roller or rollers, and means making it possible to make the said beam slide longitudinally with respect to the chassis and to immobilize this beam with respect to this chassis in a determined position.

By virtue of this sliding of the beam, the roller or rollers can thus be positioned in an appropriate way with respect to the supports intended to receive the wires, despite the unevenness of the ground.

Advantageously, the machine comprises an upright including the abovementioned roller or rollers, which is placed on the end of the beam. This upright makes it possible to ensure the perfect positioning of the roller or rollers with respect to the supports.

The machine preferably comprises an upright including the abovementioned roller or rollers, and means making it possible to make this upright pivot with respect to the machine in a vertical plane parallel to the direction of affixing of the wires and/or in a vertical plane perpendicular to this same direction, and making it possible to immobilize this upright with respect to the machine in a determined position.

This capability of orienting the upright makes it possible to position the roller or rollers appropriately with respect to the supports intended to receive the wires, despite the unevenness of the ground, in particular when this upright is placed on the end of the abovementioned beam.

For the same reason, the machine may comprise means making it possible to shift all the rollers simultaneously in a vertical direction, particularly by providing an upright with a telescopic structure.

The machine preferably comprises principal means for setting up the braking force exerted on each reel and secondary means for setting up this force, making it possible to make the strength of this force vary with respect to the strength determined with the principal means; these secondary means are coupled to the means allowing each roller to be shifted between the said retracted and extended positions, and are configured in such a way that they reduce the strength of the braking force exerted on the reel when the roller is shifted into extended position and that they increase this strength when the roller is shifted into retracted position.

This is because shifting each roller into extended position has the result of increasing the distance separating the reel and the last point at which the wire was affixed to a support, and consequently of increasing the tension exerted on the wire. In the case where there is substantial tension on the wire, the breaking point of the wire may be reached and exceeded during this shifting movement, which the said secondary means make it possible to prevent, by reducing the braking force on the reel and thus by facilitating the paying-out of the wire at the moment of this shifting of the roller. Conversely, the shifting of the roller into retracted position releases the tension on the wire, and this releasing is compensated for by increasing the braking force exerted on the reel.

For ease of understanding, the invention is described again below by reference to the attached diagrammatic drawing representing, by way of non-limiting example, one preferred embodiment of the machine to which the invention relates.

BRIEF DESCRIPTION OF THE DRAWINGS

FIG. 1 is a rear view of it, in elevation, while it is hitched to a towing vehicle;

FIG. 2 is a top view of it;

DESCRIPTION OF THE PREFERRED EMBODIMENTS

Figure 3:
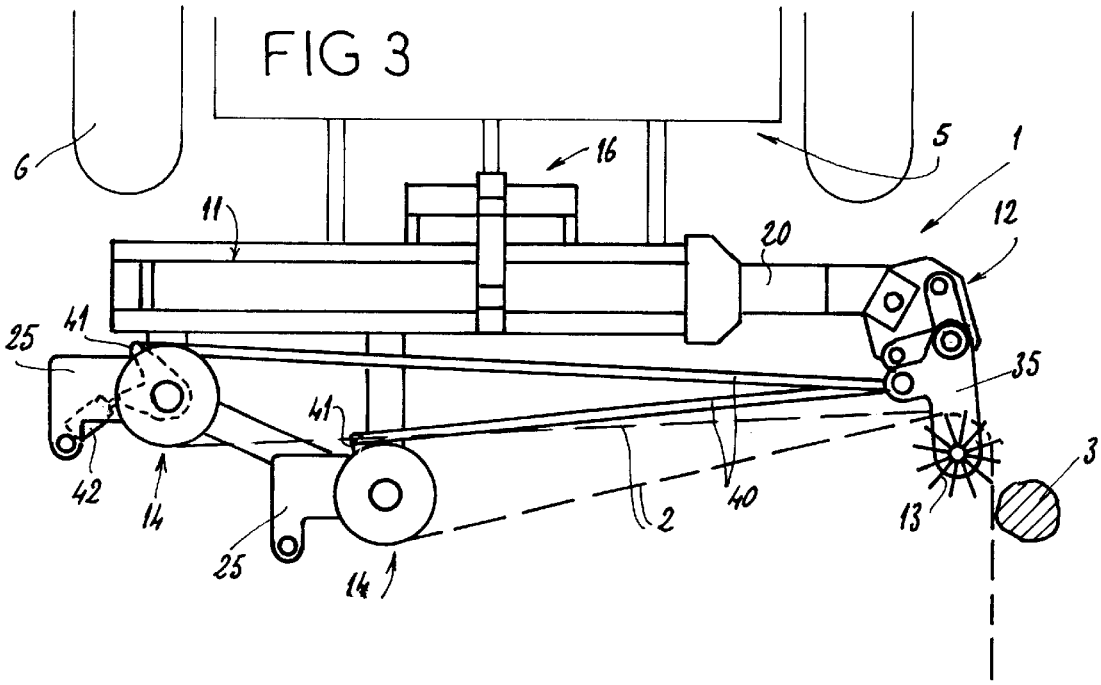
FIG. 3 is a view of it similar to FIG. 2, in another position.

The figures represent, at different angles, a machine 1 for continuous affixing of wires 2, particularly barbed wire, to posts 3 previously planted in the ground, for continuous construction of fences.

The machine 1 is hitched to a towing vehicle 5, the wheels of which are designated by the reference 6 and which comprises a towing hook of conventional type.

It comprises a chassis 10, a substantially horizontal beam 11, placed, in the course of affixing the wires 2, transversely to the direction of affixing the wires 2, an upright 12 placed on the end of the beam 11 which is turned towards the posts 3, two rollers 13 carried by this upright 12, and two braked reels 14 containing the wires 2 to be affixed.

The chassis 10 exhibits two parallel longerons 15 fixed at a distance from one another so as to delimit an elongate space between them. These longerons 15 are integral with a structure 16 for hitching to the vehicle 5.

The beam 11 consists of two superimposed longerons 20, assembled to one another. It is engaged in the elongate space delimited by the longerons 15 and can slide longitudinally with respect to them, by virtue of a jack 21 and guide means, well known in themselves and therefore not detailed.

Each longeron 20 is linked, at one end, to the upright 20 and includes, at a distance from this end, two mechanism plates 25 each supporting one of the reels 14.

Figure 4:
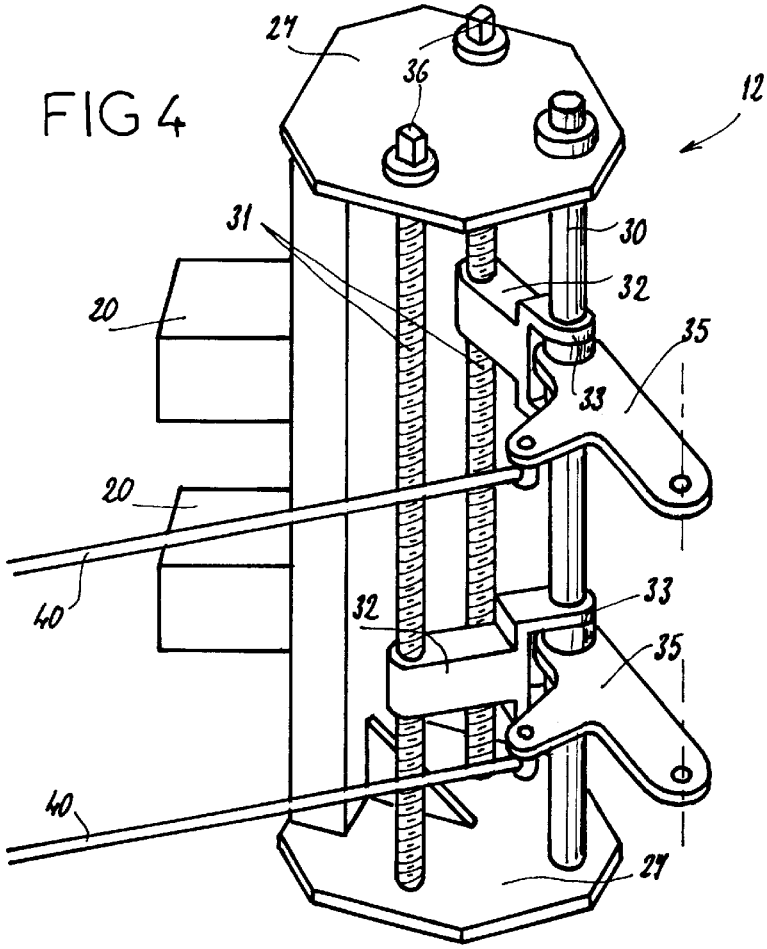
FIG. 4 is a detailed view of it, in perspective and on an enlarged scale.

The upright 12 can be seen more particularly in FIG. 4. It exhibits a longeron 26 comprising two end plates 27, between which a shaft 30 and two threaded rods 31 are mounted so that they pivot.

Mechanism plates 32 can be moved on the threaded rods 31. Each mechanism plate 32 comprises a threaded bore allowing it to be engaged, with screw threading, on one of the threaded rods 31, and two lugs 33 pierced with holes allowing it to be engaged, with the capability of sliding, on the shaft 30. These two lugs 33 delimit a clevis in which is placed a link bar 35 with two branches, this link bar 35 being engaged and able to pivot with respect to the shaft 30.

As is apparent in FIGS. 1 to 3, the main branch of each link bar 35 comprises one of the rollers 13, at its end which is not linked to the shaft 30. This roller 13 exhibits multiple notched radial branches able to receive the wire 2 around them. The other branch of each link bar 35 is connected, so that it can pivot, to a rod 40.

The threaded rods 31 extend beyond the upper plate 27, and comprise squares 36 allowing them to be manoeuvred in rotation using an appropriate tool. This manoeuvre makes it possible to shift each mechanism plate 32-link bar 35-roller 13 assembly along the upright 12.

As is apparent in FIGS. 2 and 3, the end of each rod 40 opposite the end linked to the link bar 35 is connected to one of the two branches of a link bar 41 with two branches, engaged on the axis of one of the reels 14. The other branch of each of these link bars 41 is linked, with the capability of pivoting, to the rod of a jack 42, the body of which is mounted on the mechanism plate 25.

Figure 5:
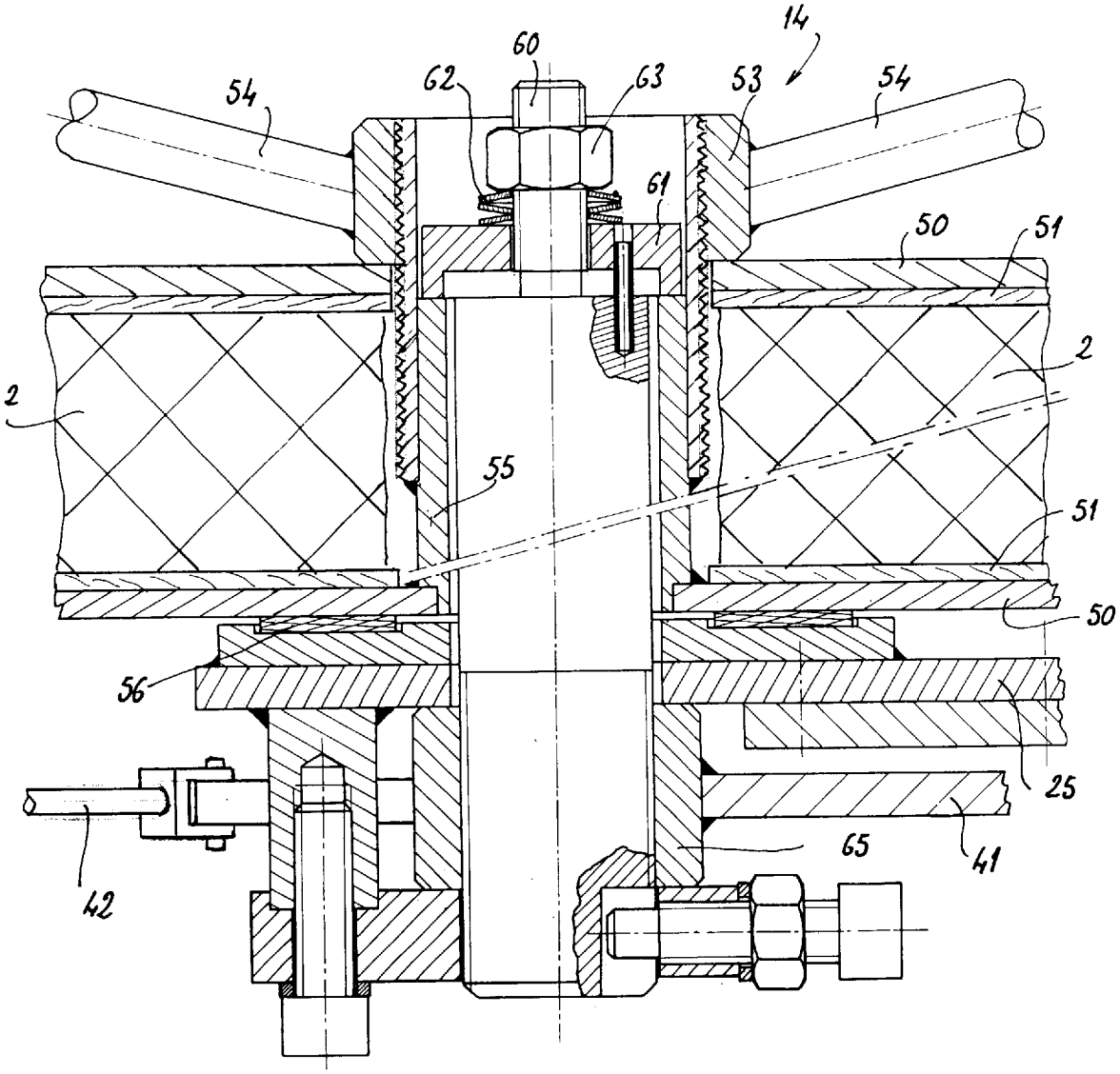
FIG. 5 is a detailed view of it, on an enlarged scale, in section along the line V—V of FIG. 2.

FIG. 5 more particularly shows one of the reels 14. This comprises two flanges 50 reinforced with plywood 51, a spindle 52, and a nut 53 with manoeuvring handles 54.

The lower flange 50 is integral with a central sleeve 55, in which the spindle 52 is engaged, exhibiting a threaded upper end onto which the nut 53 is screwed. The latter thus makes it possible to tighten the flanges 50 against the wire roller 2, in order to prevent any slippage.

The lower flange 50 rests on a liner 56 mounted on the mechanism plate 25. This liner 56 is made of a material suitable for providing braking of the reel 14 when it is clamped between the mechanism plate 25 and the lower flange 50.

The spindle 52 comprises a threaded upper axial pin 60 around which is engaged a grain 61 bearing on a shoulder which the sleeve 55 forms internally. Belleville washers 62 are placed between this ring 61 and a nut 63 screwed onto the pin 60.

At its lower part, the spindle 52 is threaded and is engaged through a threaded sleeve 65, integral with the link bar 41, bearing against the lower face of the mechanism plate 25. The direction of the threading of the spindle 52 and of the threading of the sleeve 65 is such that the sleeve 65 causes the spindle 52 to be lowered with respect to the mechanism plate 25 when the link bar 41 pivots in the anti-clockwise direction, the reel 14 being seen from above. Conversely, this spindle 52 is raised with respect to the mechanism plate 25 when the link bar 41 pivots in the clockwise direction.

The tightening of the nut 63 makes it possible to tighten the liner 56 between the mechanism plate 25 and the lower flange 50, and thus to set up, principally, the strength of the braking force applied to the reel 14.

The abovementioned pivoting of the link bar 41 in the anti-clockwise direction, occurring when the link bar 35-roller 13 assembly passes from the position shown in FIG. 2 to the position shown in FIG. 3, makes it possible, by lowering the spindle 52 with respect to the mechanism plate 25, to increase the clamping force on the liner 56, and thus to increase the strength of the braking force exerted on the reel 14.

Conversely, when the said mechanism plate 35-roller 13 assembly passes from the position shown in FIG. 3 to the position shown in FIG. 2, the strength of the braking force exerted on the reel 14 is reduced.

In practice, the wire rollers 2 are placed between the flanges 50 then the nuts 53 are tightened. The rollers 13 are adjusted in height, by manoeuvring the threaded rods 31, on the basis of the height at which the wires 2 have to be on the posts 3, then, with the nuts 63 being loosened, the wires 2 are paid out from the reels 14, engaged on the corresponding rollers 13, and the end of the wires 2 is fixed to the first post 3 of the fence.

The towing vehicle 5 then begins to move forward.

The jacks 42 are driven so as to place the rollers 13 into the extended position shown in FIG. 2, and the nuts 63 are screwed so as to set the appropriate strength of the braking force exerted on the reels 14, this force having to be such that the wires 2 are paid out while being tensioned.

On approaching the next post 3, the jacks 42 are driven in such a way as to bring the rollers 13 into the position shown in FIG. 3, in which these rollers 13 are short of the plane defined by the faces of the last two posts 3 intended to receive the wires. The machine 1 can then pass along the closest post 3, as shown in FIG. 3. This movement of the rollers 13 causes anti-clockwise shifting of the link bars 41, and thus an increase in the strength of the braking force exerted on the reels 14. This increase makes it possible rapidly to compensate for the lowering in tension of the wires 2 resulting from this change of position of the rollers 13.

As soon as the post 3 has been cleared, the jacks 42 are driven in such a way as to bring the rollers 13 back into their position shown in FIG. 2, that is to say beyond the said plane defined by the faces of the posts 3 which are intended to receive the wires 2. The latter then press against the closest post 3 and can be nailed by an operator, by means of an appropriate nailing device.

The pivoting of the link bars 41 in the clockwise direction reduces the braking force exerted on the reels 14, and thus facilitates the paying-out of the wires 2, so that any risk of breaking the wires 2, due to the excess tension resulting from the shifting of the rollers 13, is prevented.

The sliding of the beam 11 makes it possible, for itself, to adapt the positioning of the upright 12 to the position of the post 3, depending on the unevenness of the ground.

In the event that a fence has to be constructed comprising, for example, four wires, after a first pass in the course of which two of the four wires have been affixed, the rollers 13 could be shifted on the upright 12 by a distance corresponding to that which is to separate two adjacent wires of the fence, then the two intermediate wires will be affixed during a second pass.

It goes without saying that the invention is not limited to the embodiment described above by way of example, but that it, in contrast, embraces all variant embodiments. Hence, the machine may comprise more than two reels, particularly four; the upright may be linked to the beam by a ball joint allowing it to be inclined in a vertical plane parallel and/or perpendicular to the direction of affixing of the wires, jacks being provided to make it possible to cause this upright to shift and to fix it in a determined position, adapted to the position of the posts; the upright may also have a telescopic structure and comprise a jack making it possible to shift the outer element of this telescopic structure with respect to the inner element, so that the height of the rollers can be instantaneously altered as required; each jack 42 may be of the double-action type, as shown in the drawing, that is to say comprising two chambers separated by a piston linked to its rod, which are capable of being fed in turn with pressurized fluid, or may be of the single-action type, that is to say with a single chamber, a return spring then being provided to maintain normally the link bar 35-rod 40-link bar 41 assembly in the position shown in FIG. 2.

What is claimed is:

1. A machine for continuously affixing wires or a similar elongate material, onto successive supports, the machine comprising:

at least one backed reel containing the wire to be affixed;

at least one roller capable of receiving, engaged around itself, the wire paid out by the reel and of orienting this wire appropriately with a view to affixing it;

means for shifting the at least one roller between a retracted position, in which the at least one roller is situated short of a plane defined by two consecutive supports, and an extended position, in which the at least one roller is situated beyond the plane;

a chassis;

a beam mounted on the chassis in such a way that one of its ends is turned, while the wire is being affixed, towards the supports which are to receive the wire, this end including the roller or rollers, and third means for making the beam slide longitudinally with respect to the chassis and to immobilize the beam with respect to the chassis in a determined position.

2. The machine according to claim 1, wherein the machine includes at least two reels for simultaneously affixing of several wires, the number of rollers being equal to the number of reels.

3. The machine according to claim 1, further including:

second means for allowing height adjustment of the at least one roller with respect to the supports intended to receive the wire.

4. The machine according to claim 1, further including:

a supplementary roller, not corresponding to a reel, the supplementary roller being intended to roll along a previously affixed wire, and thus constituting a guide making it possible to monitor the separation between the wire or wires being affixed and the wire or wires previously affixed.

5. The machine according to claim 1, further including:

an upright including the roller or rollers, the upright being placed on the end of the beam.

6. The machine according to claim 1, further including:

an upright including the roller or rollers; and a fourth means for making the upright pivot with respect to the machine in a vertical plane parallel to the direction of affixing of the wires and/or in a vertical plane perpendicular to this direction, and making it possible to immobilize the upright with respect to the machine in a determined position.

7. The machine according to claim 1, wherein the first means makes is possible to shift the at least one roller simultaneously in a vertical direction.

8. The machine according to claim 10, further including:

principal means for setting up a braking force exerted on each reel and secondary means for setting up the force, making it possible to make the strength of the force vary with respect to the strength determined with the principal means, the secondary means are coupled to the first means allowing the at least one roller to be shifted between the retracted and extended positions, and are configured in such a way that they reduce the strength of the braking force exerted on the reel when the roller is shifted into the extended position and that they increase the strength when the roller is shifted into the retracted position.

* * * * *